US005219059A

United States Patent [19]

Furuya et al.

[11] Patent Number: 5,219,059

[45] Date of Patent: Jun. 15, 1993

[54] COIN PROCESSING APPARATUS

[76] Inventors: Yonezo Furuya, 3-8-18, Matsugaoka, Hatoyama-machi, Hiki-gun, Saitama; Ichiro Fukuda, 1672-1-408, Imafuku, Kawagoe-shi, Saitama; Genzo Yoshizawa, 17-7, Iwabuchi-cho, Kita-ku, Tokyo, all of Japan

[21] Appl. No.: 816,762

[22] Filed: Jan. 2, 1992

[30] Foreign Application Priority Data

Apr. 16, 1991 [JP] Japan ..... 3-084130

[51] Int. Cl.[5] ..... G07D 5/08

[52] U.S. Cl. ..... 194/200; 194/203; 194/318

[58] Field of Search ..... 194/317, 318, 319, 345, 194/203, 200

[56] References Cited

U.S. PATENT DOCUMENTS 4,601,380 7/1986 Dean et al. ..... 194/318
4,690,263 9/1987 Yokomori ..... 194/345 X

FOREIGN PATENT DOCUMENTS 58-38833 8/1983 Japan .
59-13797 3/1984 Japan .
61-152183 9/1986 Japan .
63-27251 7/1988 Japan .
2-217986 8/1990 Japan .
152340 2/1991 Taiwan .

*Primary Examiner*—F. J. Bartuska

[57] ABSTRACT

A coin processing apparatus arranged to automatically execute a cancellation process for canceling acceptance of an inserted coin by detecting, on the basis of output levels of receiving coils in a plurality of sets of coin selecting coils disposed on a coin path, a fact that the inserted coin has been guided into a return path through the operation of a return lever, and also to judge the occurrence of coin jamming and coin counter-flow on the basis of the output levels of the receiving coils. The output level of the receiving coil in each of the plurality of sets of coin selecting coils is monitored so as to carry out the automatic cancellation process in case the output levels of the respective receiving coils concurrently exceed a predetermined threshold level and persist longer than a predetermined period of time. In case the output level of the receiving coil in at least one of the plurality of sets of coin selecting coils exceeds the predetermined threshold level and persists longer than a second predetermined period of time, it is judged that the coin jamming has occurred. Further, in case the output level of the receiving coil of the most downstream one of the plurality of sets of coin selecting coils exceeds the predetermined threshold level and the detection output occurs again after the lapse of a third predetermined period of time from the time point when the detection output has once ceased, then the coin judged as a true coin is treated as a false coin.

2 Claims, 10 Drawing Sheets

COIN PROCESSING APPARATUS

BACKGROUND OF THE INVENTION

1. Field of the Invention

The present invention relates to a coin processing apparatus for use with vending machines, coin exchanging machines, and other types of service machines or the like. More particularly, this invention relates to a coin processing apparatus which is so designed that if a coin return lever is operated to guide an inserted coin lying in a coin path to a coin return path, this fact is detected on the basis of an output level of a receiving coil of a coin selecting coil device so as to automatically execute a cancellation process for canceling the acceptance of the inserted coin, and also the occurrence of coin jamming and/or counter-flow is detected on the basis of the output level of the receiving coil.

2. Description of the Related Art

Conventional vending machines or the like are arranged such that if a coin return lever is operated, a gate lever of a coin selector is pushed in response thereto so that a gate provided in front of a coin path is opened and a deformed coin or the like jammed in the coin path is forcibly delivered to a coin return port through a coin return path.

If a coin lying in the coin path is forcibly returned through operation of the coin return lever, then accurate counting of the inserted coins is not guaranteed. To cope with this, it has conventionally been arranged that when the coin return lever is operated or when the gate lever is pushed, this is directly detected, and acceptance of the inserted coin is rejected in response to an output resulting from the detection, thus executing a so-called cancellation process for returning the inserted coin.

To be able to achieve such direct detection of the coin return lever being operated or the gate lever being pushed, however, it is necessary to provide a special sensor either on the coin return lever or the gate lever, and thus, it is required that a space for such a special sensor be secured. Further, it is also required that means for monitoring the output of the special sensor be provided. Obviously, this leads to such disadvantages that the coin processing apparatus becomes large-sized and the process turns out to be complicated.

Furthermore, in case a deformed coin or the like is inserted into the coin path, such a deformed coin may be jammed at the portion of the coin path where a coin selecting coil is provided. To cope with this, it has also been the conventional practice to provide a special coin jamming sensor for detecting such coin jamming. Consequently, it is further required that a space for the special coin jamming sensor be secured and means for monitoring the output of the special coin jamming sensor be provided. Disadvantageously, this constitutes another cause for increasing the size of the apparatus and making the process complicated.

With the conventional coin processing apparatus, the design has been made such that when a coin passes through the coin selecting coil provided in the coin path and is judged as a true coin by the coin selecting coil, the apparatus is ready to accept the coin thus judged as a true coin. However, in case the inserted coin is one having a piece of thread attached thereto and is returned, by pulling the thread, back to the position where the coin selecting coil is provided, then the coin selecting coil is liable to judge this coin as a newly inserted coin; thus, there arises such a problem that the coin count is unduly increased without any coin being actually inserted.

To cope with this, the conventional coin processing apparatus of this type is provided with coin counter-flow preventing means which is mechanically arranged to prevent the coin, which has once passed through the coin selecting coil in the coin path, from being returned to the position where the coin selecting coil is disposed.

With such an arrangement, however, it is required that a space for mounting such coin counter-flow preventing means be secured, and this constitutes a further cause for increasing the size of the coin processing apparatus.

SUMMARY OF THE INVENTION

Accordingly, it is an object of the present invention to provide a coin processing apparatus which is so designed that cancellation process can be automatically effected without any special sensor for the cancellation process, so that the size of the apparatus can be reduced and the process can be simplified.

Another object of the present invention is to provide a coin processing apparatus which is so designed that coin jamming can be detected without any special sensor for detecting coin jamming.

Still another object of the present invention is to provide a coin processing apparatus capable of coping with coin counter-flow without any special coin counter-flow preventing means.

To achieve the foregoing objects, the coin processing apparatus according to the present invention comprises a plurality of sets of coin selecting coils provided along a coin path for discriminating coins passing through the coin path, each set including an exciting coil excited by a signal having a predetermined frequency and a receiving coil disposed opposite to the exciting coil, a coin return lever arranged, when operated, for isolating the exciting coil and the receiving coil in each of said plurality of sets of coin selecting coils from each other, thereby permitting a coin lying in the coin path to be guided to a coin return path, and a control unit arranged for detecting that the respective output levels of the receiving coils in the plurality of sets of coin selecting coils concurrently exceed a predetermined threshold level, and if the output resulting from the detection persists longer than a first predetermined period of time, for performing a cancellation process by which the acceptance of a coin is canceled.

Further, with the foregoing arrangement, the control unit is arranged for respectively detecting that the output level of the receiving coil in each of said plurality sets of coin selecting coils exceeds the predetermined threshold level, and if at least one of the output levels of the receiving coils in the plurality of sets of coin selecting coils persists longer than a second predetermined period of time, for judging that coin jamming has occurred.

Still further, with the above-described arrangement, the control unit is arranged for detecting that the output level of the receiving coil in the most downstream one of the plurality of sets of coin selecting coils exceeds the predetermined threshold level, and if the detection output occurs again after a lapse of a third predetermined period of time from the point of time when the output resulting from the detection was interrupted, for performing a "true coin cancelling process" in which the coin judged as a true coin is treated as a false coin.

As will be appreciated from the foregoing explanation, according to the present invention, since the coin processing apparatus is so arranged that the output level of the receiving coil in each of the plurality of sets of coin selecting coils is monitored so that the cancellation process for canceling the acceptance of the inserted coin is automatically performed, when a status in which the output levels of the receiving coils in the plurality of sets of coin selecting coils concurrently exceed a predetermined threshold level persists for a period longer than the predetermined period time, the cancellation process can be automatically performed without any special sensors for the cancellation process, whereby the size of the apparatus can be minimized and the process can be simplified.

Another advantage is that coin jamming can readily be judged and coin counter-flow which tends to be caused by a prank can be coped with.

DESCRIPTION OF THE PREFERRED EMBODIMENTS

Figure 1:
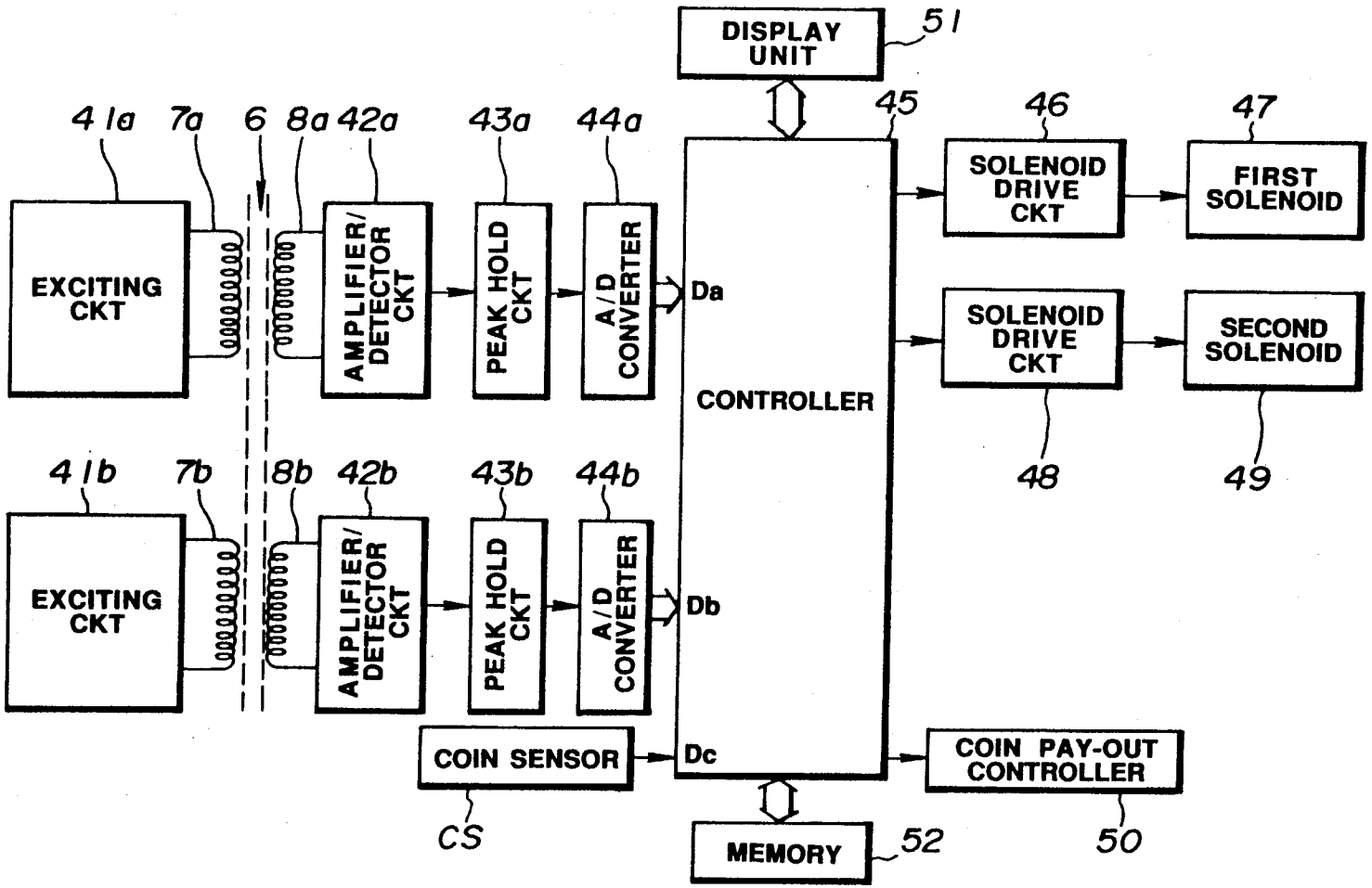
FIG. 1 is a block diagram showing the coin processing apparatus according to an embodiment of the present invention.

Referring to FIG. 1, there is shown, in a block diagram, the coin processing apparatus according to an embodiment of the present invention.

Before explaining the block diagram in FIG. 1, a description will first be made of the external appearance, details of the main structure, and selecting structure of the embodiment with reference to FIGS. 5 to 10.

Figure 5:
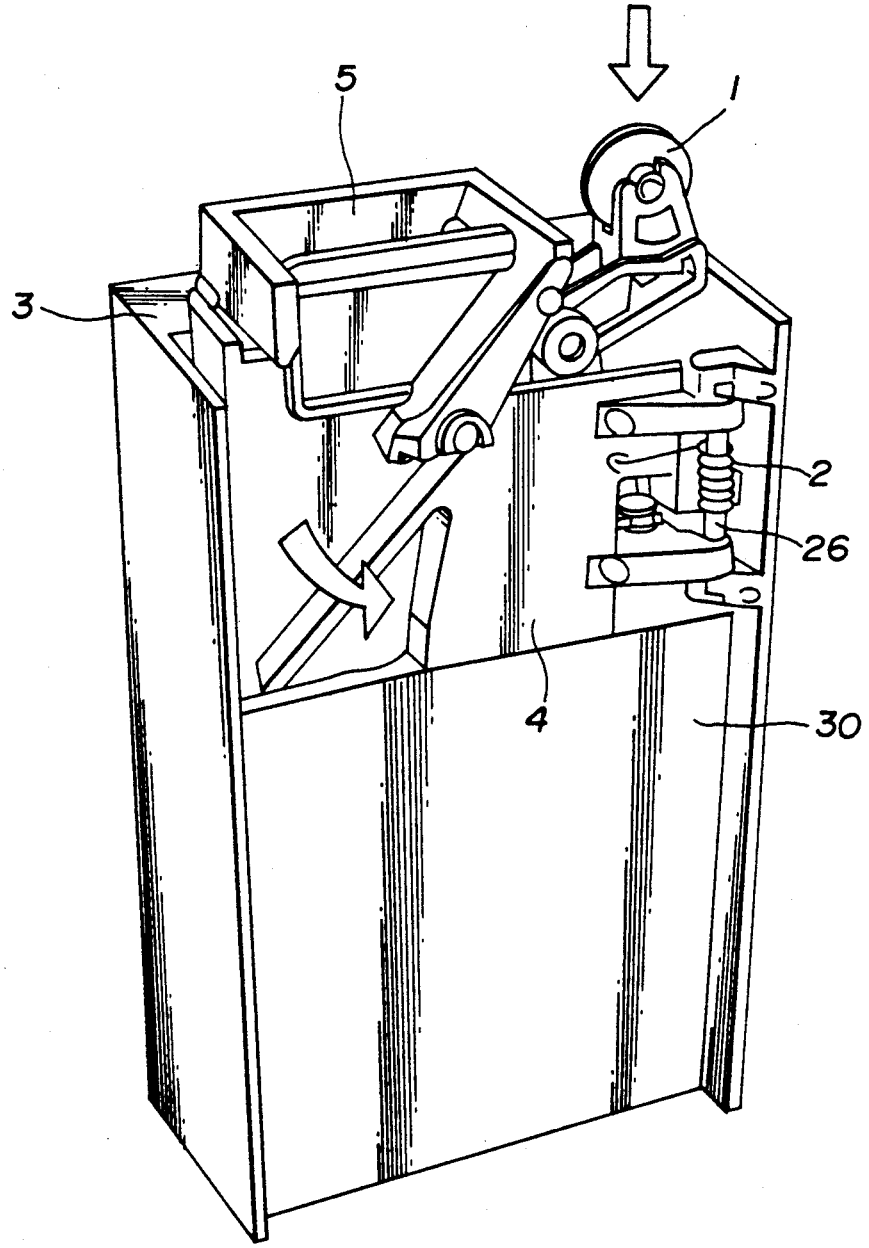
FIG. 5 is a perspective view showing the external appearance of the coin processing apparatus according to the embodiment shown in FIG. 1.

FIG. 5 illustrates the external appearance of the coin processing apparatus according to this embodiment, which comprises a gate lever 1 which is arranged to be pushed down, as indicated by an arrow mark, through operation of a coin return lever (not shown); a main plate 3; a gate plate 4 which rotates in the direction shown by an arrow mark about a shaft 26 against the biasing force of a spring 2; a coin insert slot 5; and a coin sorting unit 30.

Figure 6:
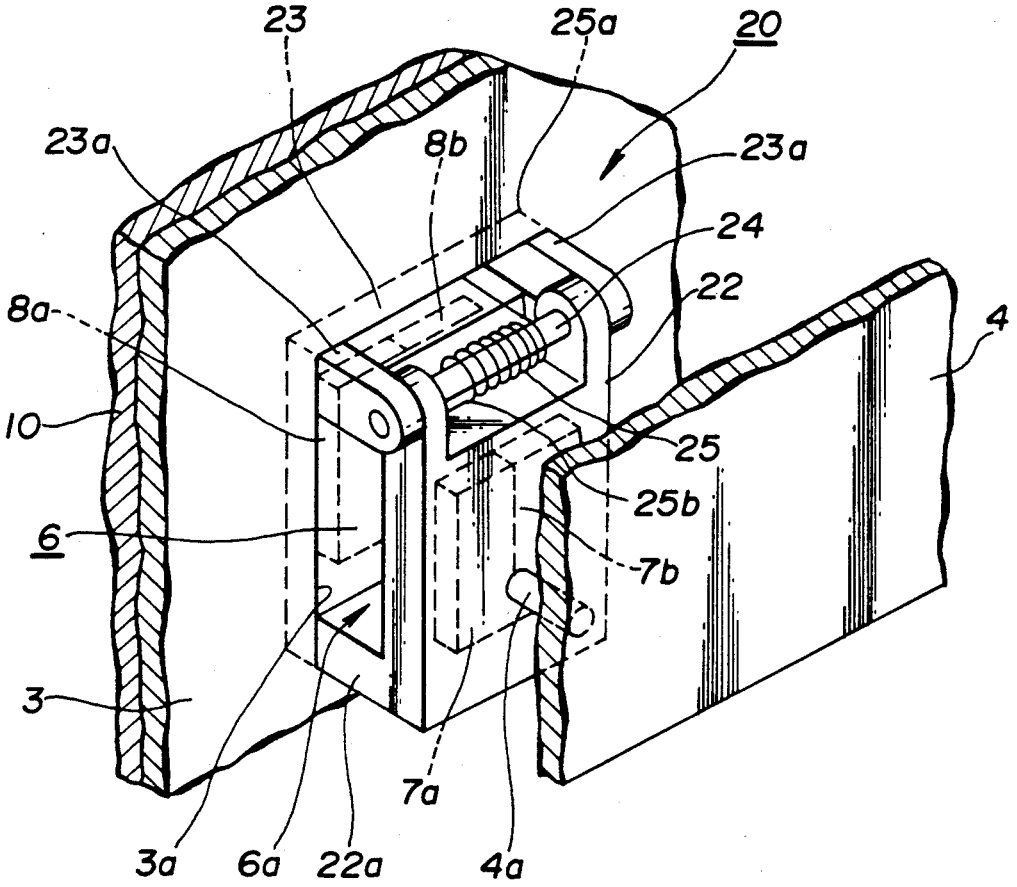
FIG. 6 is a fragmentary, partially cut-away, view showing the main portion of a coil sensor unit provided in the embodiment shown in FIG. 1.

FIG. 6 shows the details of the structure of a coil sensor unit 20 provided at the back of the gate plate 4. As shown in FIG. 6, the coil sensor unit 20 comprises a first housing member 22 accommodating an upstream-side exciting coil **7*a* and a downstream-side exciting coil 7*b*, and a second housing member 23 accommodating an upstream-side receiving coil 8*a* and a downstream-side receiving coil 8*b*. The housing members 22 and 23 are provided as separate elements. The first housing member 22 is pivotally supported through a shaft 24 to a pair of arms 23*a* which extend laterally from the upper end portion of the second housing member 23**.

The first housing member 22, which is configured in a substantially L-shaped cross-section, is disposed in opposing relationship to the second housing member 23 and spaced apart from an laterally extending lower end portion **22*a* from a predetermined distance. Between the two housing members, a coin path 6*a* which constitutes a part of the coin path 6 is formed. A coil spring 25 is loaded on the shaft 24 supporting the first housing member 22, with the opposite ends 25*a* and 25*b* thereof being engaged with the second and first housing elements 23 and 22 respectively. Thus the two housing members are normally biased by the coil spring 25 in such a direction that the first housing member 22 is pivoted about the shaft 24 counter-clockwise away from the second housing member 23**.

Figure 7:
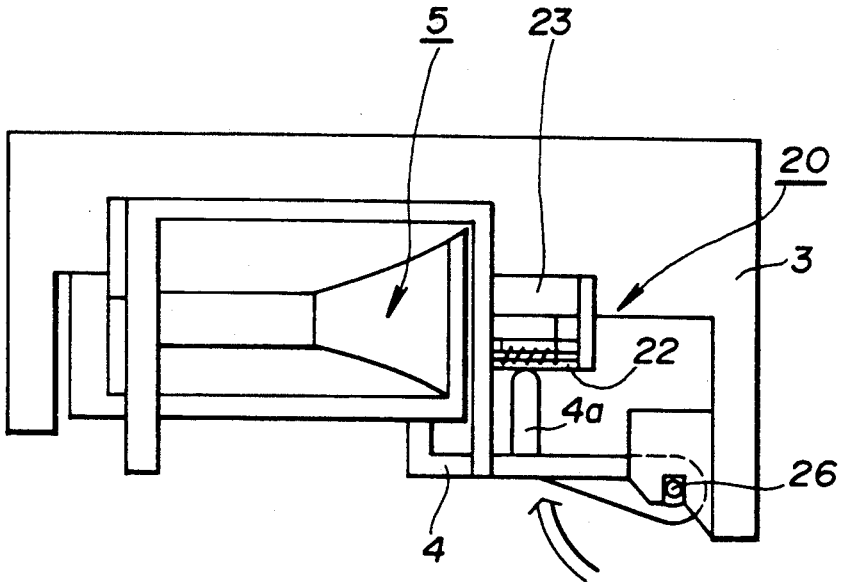
FIG. 7 is a top plan view of the coil sensor unit shown in FIG. 6.

The gate plate 4, which covers the coil sensor unit 20, is provided with a projection **4*a* extending in opposing relationship to the first housing member 22. As shown in FIG. 7 which is a top plan view of FIG. 6, the gate plate 4 is normally biased so as to cover the main plate 3 and the coil sensor unit 20 in a direction, as shown by an arrow mark in FIG. 7, about the shaft 26 by means of the spring 2 shown in FIG. 5 thereby allowing the projection 4*a* to abut against the first housing member 22. By the pushing force of the projection 4*a*, the first housing member 22 is pivoted about the shaft 24 clockwise against the biasing force of the coil spring 25, so that a lower end portion 22*a* of the first housing member 22 is brought in close contact with a lower end portion of the second housing member 23**.

The second housing member 23 is securely fixed to a sub plate 10 covering the back surface of the main plate 3. With the sub plate 10 attached to the main plate 3, the surface of the second housing member 23 is exposed to the coin path 6 through an opening **3*a* formed on the main plate 3**.

Figure 8:
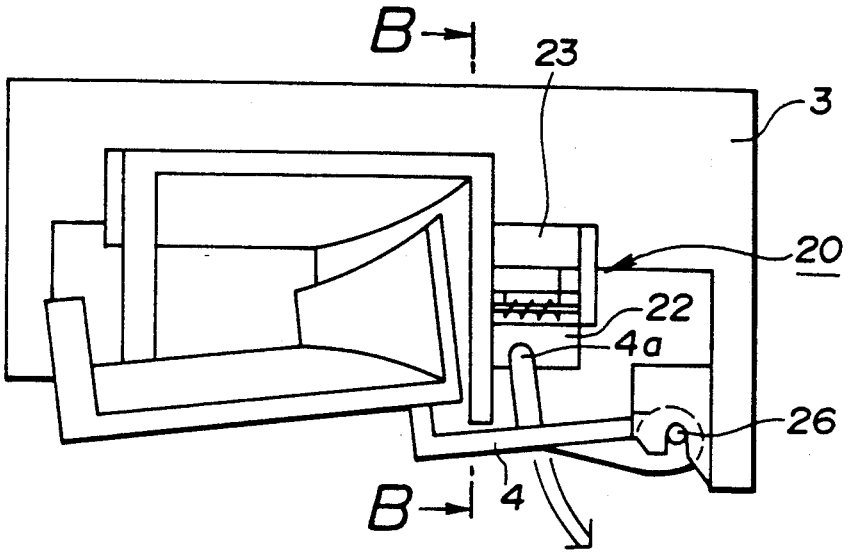
FIG. 8 is a view similar to FIG. 7, wherein a gate plate of the coil sensor unit shown in FIG. 6 is released.
Figure 9:
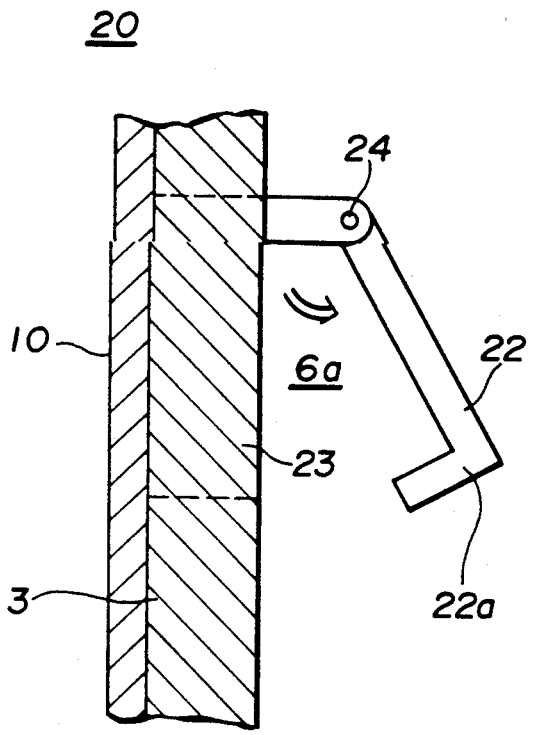
FIG. 9 is a sectional view taken along the line B—B of FIG. 8.

With such an arrangement, if the coin return lever (not shown) is operated so that the gate lever 1 is downwardly pushed as shown by the arrow mark in FIG. 5, then the gate plate 4 is rotated counter-clockwise as shown by the arrow mark in FIGS. 5 and 8 against the biasing force of the spring 2 (FIG. 5) by which the gate plate 4 is biased clockwise about the shaft 26. In this way, as shown in FIG. 9 which is a sectional view taken along the line B—B of FIG. 8, the first housing member 22 is rotated counter-clockwise about the shaft 24 by the biasing force of the coil spring 25 (FIG. 6). Consequently, the coin path **6*a* is opened at the bottom so that a deformed coin or the like, which is jammed in the coin path 6*a*** is dropped by the gravity and led to a coin return path (not shown).

Furthermore, at this time, because the distance between the exciting coils **7*a* and 7*b* accommodated in the first housing member 22 and the receiving coils 8*a* and 8*b* accommodated in the second housing member 23 changes, the state of electromagnetic coupling between the exciting coils 7*a* and 7*b* and the receiving coils 8*a* and 8*b* changes correspondingly. As will be described hereinafter, according to this embodiment, changes in the state of electromagnetic coupling between two sets of opposing coils, i.e., between the exciting coil 7*a* and the receiving coil 8a and between the exciting coil 7b and the receiving coil 8b**, are detected, and when the two sets of coils continue to exhibit such changes in the state of electromagnetic coupling longer than a predetermined period of time, a predetermined cancellation process is executed.

As similar to the above, the state of electromagnetic coupling between the two sets of coils, i.e., between the exciting coil 7a and the receiving coil 8a and between the exciting coil 7b and the receiving coil 8b also changes when the a coin passes through the coin path. By utilizing this feature, a predetermined process for eliminating an abnormal state such as coin jamming in the coin path is effected.

Further, after a true coin was inserted and a level of the voltage induced in the downstream-side receiving coil 8b has returned to a predetermined stand-by level, a level of the voltage induced in the downstream receiving coil 8b after the voltage level has returned to the predetermined stand-by level is monitored, and if this voltage level becomes a non-stand-by level (a level other than the stand-by level), it is judged that the coin is moved backward by a prank such as pulling back of the coin with a piece of thread fixed thereto, and thus a process for treating the true coin as a false one is executed.

Figure 10:
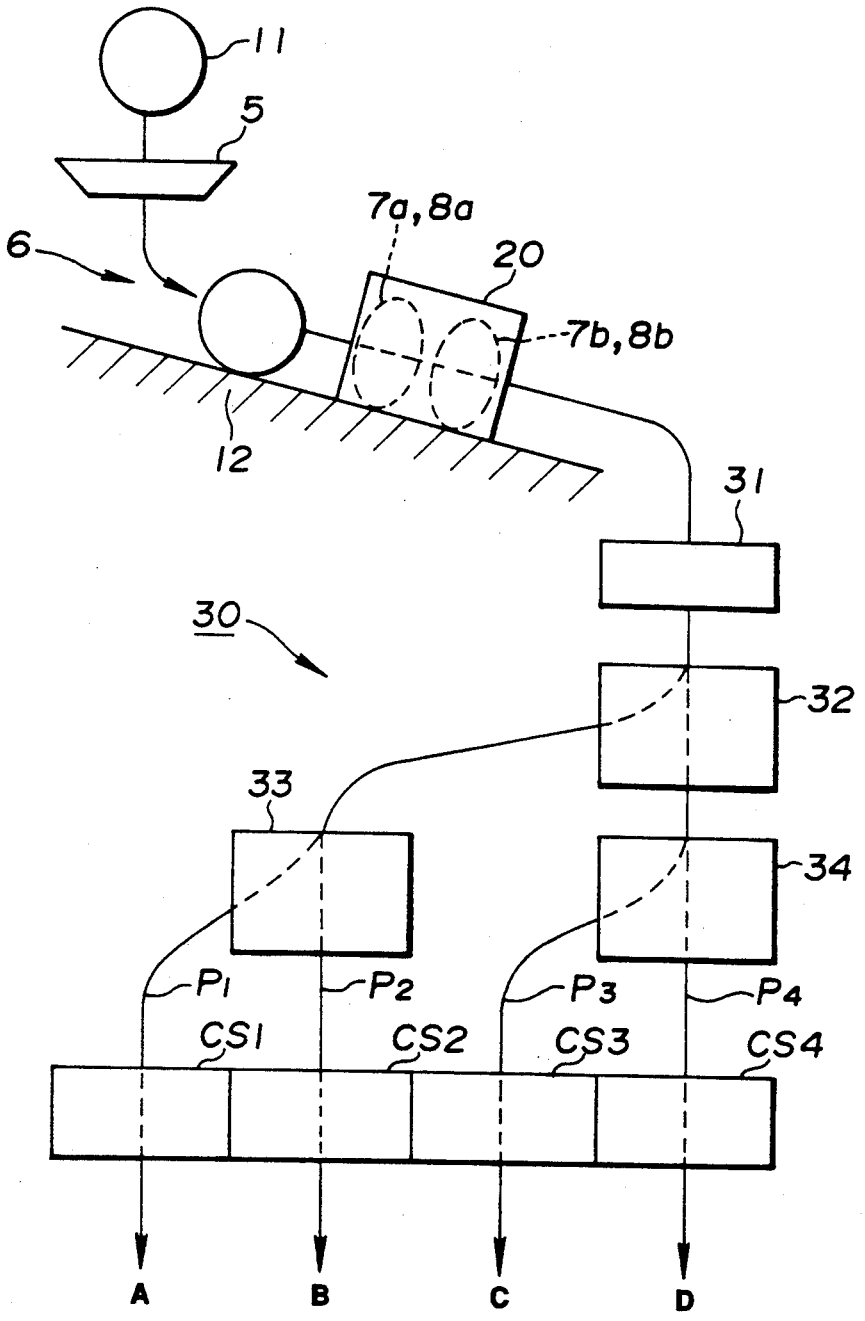
FIG. 10 is a conceptual view useful for explaining the coin selecting operation of the apparatus shown in FIG. 1.

FIG. 10 shows a coin selecting mechanism according to this embodiment, which includes the coin sorting unit 30 shown in FIG. 5. In FIG. 10, a coin 11 inserted through the coin insert slot 5 rolls on a rail guide 12 which forms the coin path 6, and is judged by the coil sensor unit 20 whether it is a true coin or a false one and the type thereof as well. Having passed through the coil sensor unit 20, the coin is sorted between a true one and a false one by a first sorting gate 31, which is driven by a first solenoid as described hereinafter. The first solenoid is driven on the basis of an output resulting from the judgement by the coil sensor unit 20 as to whether the coin is a true one or a false one.

The false coin as sorted at the first sorting gate 31 is returned to a coin return port (not shown) through the return path (not shown).

The true coin as sorted at the first sorting gate 31 is led to a second sorting gate 32 which is driven by a second solenoid as described hereinafter. The second solenoid is driven on the basis of a coin type judgment output derived from the coil sensor unit 20. More specifically, the coin selecting apparatus of this embodiment is capable of selecting four different types of coins, i.e., coins A, B, C and D. In the second sorting gate 32, the four types of coins A, B, C and D are sorted into two groups, say a first group including the coins A and B and a second group including the coins C and D in accordance with the driving condition of the second solenoid.

Coins of the first group including the coins A and B as sorted at the second sorting gate 32 are introduced to a first mechanical sorting unit 33 which mechanically discriminates the coins A and B on the basis of the difference between the diameters of the coins A and B and delivers the coins A and B to coin paths P1 and P2, respectively.

Coins of the second group including the coins C and D as sorted at the second sorting gate 32 are introduced to a second mechanical sorting unit 34 which mechanically discriminates the coins C and D on the basis of the difference between the diameters of the coins C and D and delivers the coins C and D to coin paths P3 and P4, respectively.

The coin paths P1, P2, P3 and P4 are provided with coin sensors CS1, CS2, CS3 and CS4 for detecting the coins A, B, C and D to be introduced thereto, respectively. Each of the coin sensors CS1, CS2, CS3 and CS4 comprises, for example, a light emitting element and light receiving element for optically detecting the coins A, B, C and D passing through the coin paths P1, P2, P3 and P4 respectively. In the coin sorting apparatus of this embodiment, the number of coins as received is counted on the basis of the output of the coin sensors CS1, CS2, CS3 and CS4.

Referring again to FIG. 1, the exciting coils 7a and 7b accommodated in the first housing member 22 shown in FIG. 6 are excited by exciting circuits 41a and 41b respectively with a predetermined frequency suitable for discrimination of coins. The receiving coils 8a and 8b accommodated in the second housing member 23 shown in FIG. 6 respectively outputs a predetermined attenuation waveform signal when the coin passes through the coin path 6. Such attenuation waveform signal is amplified and detected in amplifier/detector circuits 42a and 42b, and their peak values are held in peak-hold circuits 43a and 43b. The peak values thus held are converted to digital values in analog/digital converters (A/D converters) 44a and 44b and then passed to a control unit 45.

The control unit 45 detects the true/false aspect as well as the type of the coin on the basis of the outputs of the A/D converters 44a and 44b.

A first solenoid 47 is energized by a solenoid drive circuit 46 on the basis of the output of the control unit 45 and drives the first sorting gate 31 shown in FIG. 10.

A second solenoid 49 is energized by a solenoid drive circuit 48 on the basis of the output of the control unit 45 and drives the second sorting gate 32 shown in FIG. 10.

A coin pay-out control unit 50 executes the control to pay out part or whole of the inserted coins, as occasion demands.

A display unit 51 displays information processed in the control unit 45, as required, and a memory 52 stores data required for the control by the control unit 45.

A coin sensor CS corresponds to the sensors SC1, SC2, SC3 and SC4 shown in FIG. 10. The output of this coin sensor is passed to the control unit 45 in which the number of accepted coins is counted on the basis of the output of the coin sensor CS.

With this embodiment, if the gate is opened through operation of the coin return lever (not shown), the first housing member 22 accommodating the exciting coils 7a and 7b therein is rotated about the shaft 24 as shown in FIGS. 8 and 9, so that the distance between the exciting coils 7a and 7b and the receiving coils 8a and 8b accommodated in the second housing member 23 is changed. As a result, the state of electromagnetic couplings between the exciting coils 7a and 7b and the receiving coils 8a and 8b change and the outputs of the receiving coils 8a and 8b decrease.

Figure 2:
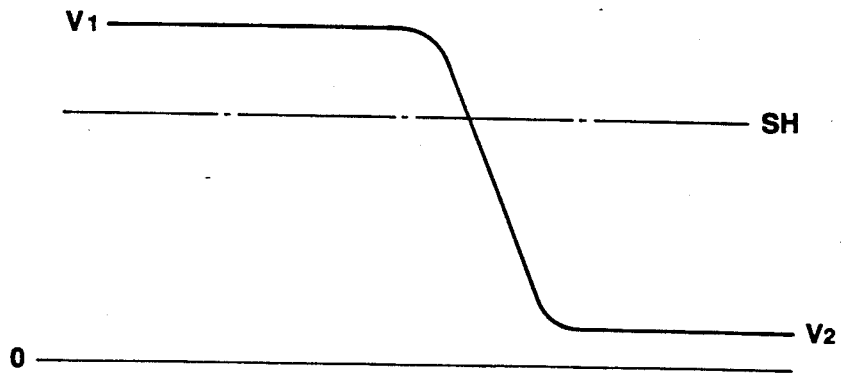
FIG. 2 illustrates a waveform useful for explaining the operation of the apparatus shown in FIG. 1.

Such a decrease in the outputs of the receiving coils 8a and 8b is shown in FIG. 2 wherein the output of the receiving coils 8a and 8b represents a predetermined level V1 in a stand-by state in which no coin is inserted. However, if the gate is opened through operation of the coin return lever, the output level of the receiving coil 8a and 8b drops from the level V1, beyond a threshold level SH, down to a level V2. Such a decrease in the output level is detected by comparing coin data Da and Db inputted through the amplifier/detector circuits 42a, 42b, peak-hold circuits 43a, 43b and A/D converters 44a, 44b, with the aforementioned threshold level SH in the control unit 45. In case it is detected by the control unit 45 that both the coin data Da and Db are at a level other than the stand-by level, i.e., Da<SH and Db<SH, and if such a state persists longer than a predetermined period of time, then the control unit 45 executes the predetermined cancellation process when the above-said predetermined period of time elapses.

In case a bent coin or the like as put in from the coin insert slot 5 is jammed in the coin path 6, the output of the receiving coil 8a or 8b drops down to the level V2 which varies depending on the type of the jammed coin, and such a state is maintained. Thus, the control unit 45 compares the coin data Da and Db with the threshold level SH as in the above case. If it is detected by the control unit 45 that the coin data Da or Db is at a level other than the stand-by level, i.e., Da<SH or Db<SH and if such a state persists longer than the predetermined period of time, then the control unit 45 judges after the predetermined period of time elapses that coin jamming has occurred and executes the process for eliminating such an abnormal state.

If the coin has passed through the coin path 6a in a normal manner, Da and Db, in the named order, change from V1 to V2 (in this case, the level V2 varies depending on the type of the coin as passed), and Da and Db, in the named order, change from V2 to V1. Thus, it is judged that the coin which passed through the coin sensor 20 is a true one. During a predetermined period of time after the coin data Db has changed from V2 to V1 or at a time point when the predetermined time period elapses, the coin data Db is monitored. When it is detected that the coin data Db has again changed from V1 to V2, the control unit 45 judges that the coin is moved backward by a prank such as pulling back of the coin with a piece of thread fixed thereto, treats the coin judged as a true coin to be a false one and executes the process subsequent thereto.

The operation of the embodiment shown in FIG. 1 will now be described in detail with reference to the flowchart of FIG. 3 and the timing chart of FIG. 4.

In FIG. 1, the control unit 45 periodically reads in the coin data Da and Db provided by the A/D converters 44a and 44b (step 101) and judges, on the basis of the read-in data Da and Db, as to whether or not a coin was inserted (step 102). If it is judged that no coin was inserted, then judgement is made as to whether or not both of the data Da and Db are lower than the threshold level SH, i.e., whether or not such a relationship that Da<SH and Db<SH is established (step 103). If it is judged YES, then check-up is made as to whether or not such a state persists for a time period T1 counted by a cancel recognition timer (step 104). In case the above-mentioned state persists for the time period T1 counted by the cancel recognition timer, it is assumed that the coin return lever was operated, then the predetermined cancellation process is performed (step 105). The operation for this case is illustrated under the heading (b) "RETURNED LEVER OPERATED" in the timing chart shown in FIG. 4.

The cancellation process as referred to here is performed by returning all the accepted coins by driving the coin pay-out control unit 50 shown in FIG. 1, and resetting the displayed amount of the inserted coins to zero displayed on the display unit 51, by controlling the display unit 51.

Figure 3:
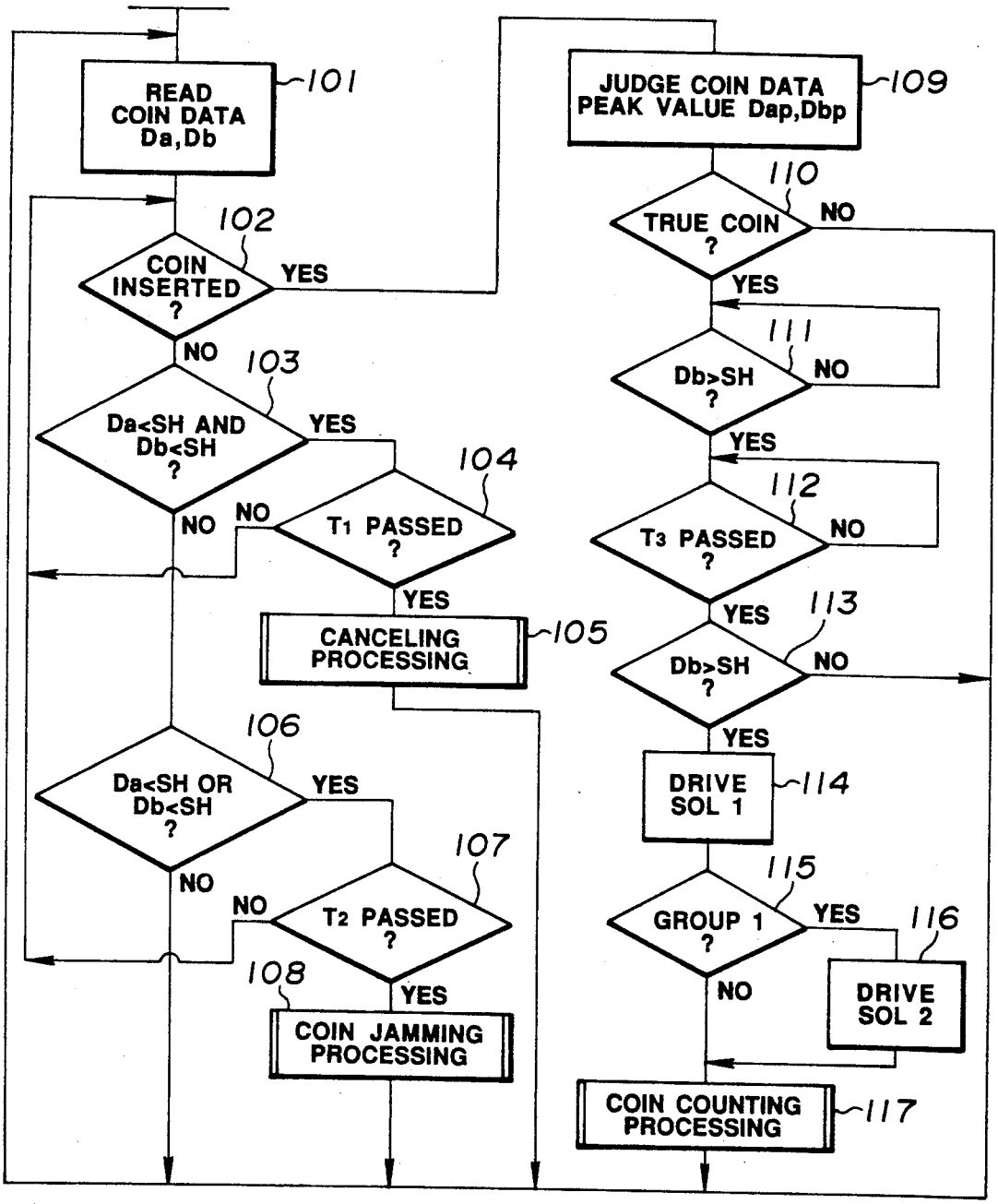
FIG. 3 shows a flowchart useful for explaining the operation of the apparatus shown in FIG. 1.

If it is judged NO at the step 103 in FIG. 3, then judgment is made as to whether either one of the coin data Da and Db is lower than the threshold level SH, i.e., whether or not such a relationship that Da<SH or Db<SH is established (step 106). If it is judged YES, then check-up is made as to whether such a state persists for a time period T2 counted by a coin jamming recognition timer (step 107). If such a state persists for the time period T2 measured by the coin jamming recognition timer, then the predetermined coin-jamming eliminating process is executed (step 108).

Figure 4:
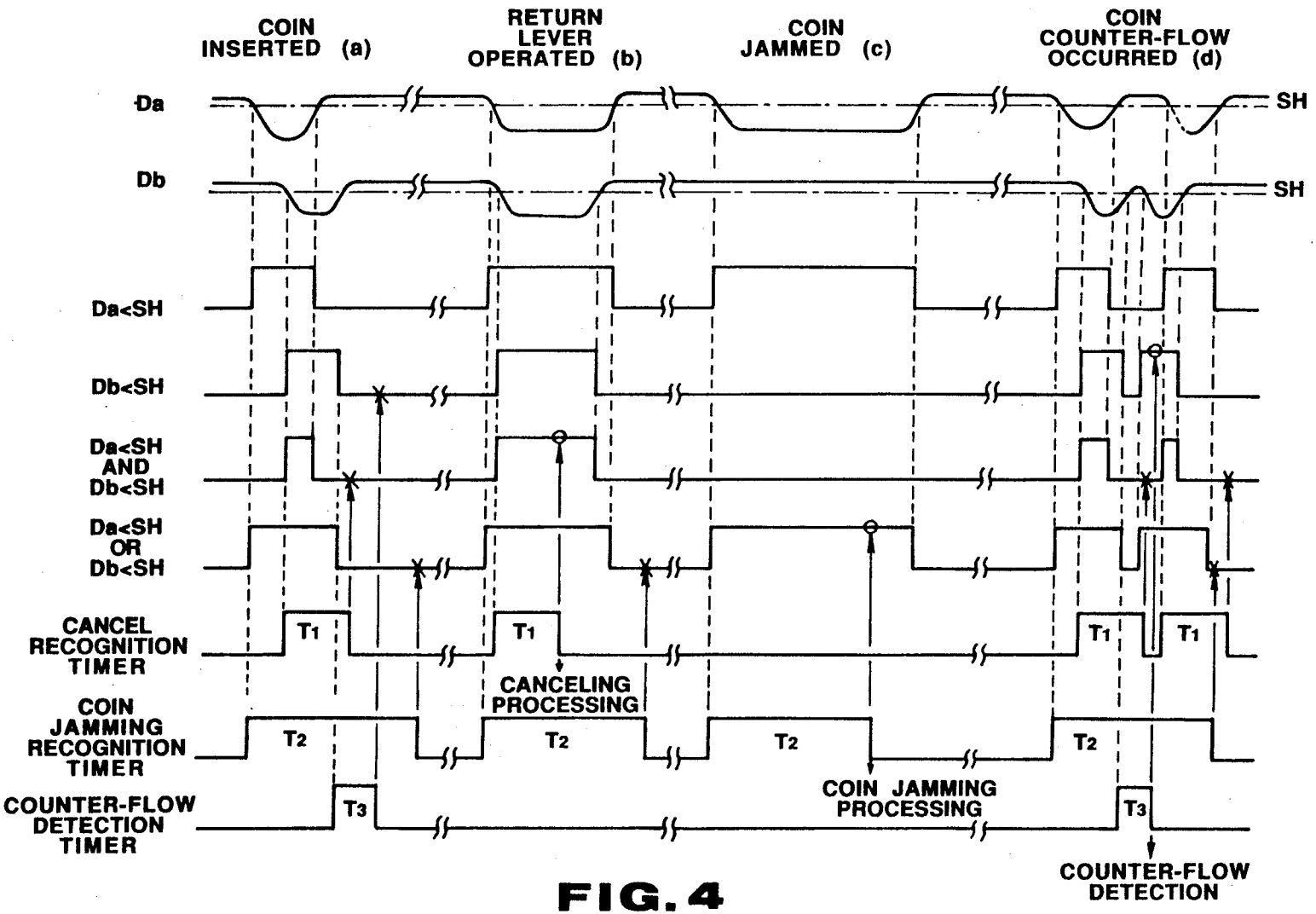
FIG. 4 shows a timing chart useful for explaining the operation of the apparatus shown in FIG. 1.

The operation for this case is illustrated under the heading (c) "COIN JAMMED" in the time chart shown in FIG. 4.

The coin-jamming eliminating process as referred to here is performed by causing the abnormal state to be displayed on the display unit 51 or by prohibiting acceptance of coins, for example. If Da>SH and Db>SH, then the routine returns to the step 101.

In case it is judged at the step 102 that a coin was inserted, then coin data peak values Dap and Dbp are measured (step 109), and the control unit 45 stores such peak values temporarily. The coin data peak values Dap and Dbp thus stored temporarily are compared with a reference value previously stored in the memory 52 and corresponding to respective coin denomination, and based on the result of the comparison, judgment is made as to whether or not the inserted coin is a true coin (step 110). If it is judged that the inserted coin is a true coin, then judgment is made as to whether or not the coin data Db is higher than the threshold level SH, i.e., Db>SH (step 111). If Db>SH, then it is confirmed that the coin has passed through the position where the downstream-side exciting coil 7b and the receiving coil 8b are provided. When a time period T3 counted by a counter-flow detection timer elapses in such a state (step 112), the coin data Db is again compared with the threshold level SH, and judgment is made as to whether or not Db>SH (step 113). If it is judged YES, then it is judged that there is no counter-flow of the coin, and the first solenoid (SOL1) 47 is energized (step 114) so that the sorting gate 31 is operated to permit the true coin to be led to a true coin path (not shown).

Subsequently, check-up is made as to whether the coin thus judged as true is identical in denomination with the coin A or B, i.e., whether or not the coin belongs to the aforementioned first coin group (step 115). If the coin belongs to the first coin group, then the second solenoid (SOL2) 49 is energized (step 116) so that the coins A and B belonging to the first coin group are sorted by means of the second sorting gate 32 of FIG. 10. In case the coin judged as true is identical in denomination with the coins C and D belonging to the second coin group, then the second solenoid (SOL2) 49 is not energized, and sorting of the coins C and D belonging to the second coin group is effected by the second sorting gate 32 of FIG. 10.

The coins A and B as sorted by the second sorting gate 32 are further sorted on the basis of the difference between the diameters thereof by the first mechanical sorting unit 33, so that the coins A and B are led to the coin paths P1 and P2 respectively. Similarly, the coins C and D are sorted on the basis of the difference between the diameters thereof by the second mechanical sorting unit 34, so that the coins C and D are led to the coin paths P3 and P4 respectively.

Subsequently, a coin counting process is carried out (step 117). More specifically, this coin counting is effected on the basis of the outputs of the coin sensors SC1, SC2, SC3, and SC4 provided in the coin paths P1, P2, P3 and P4 respectively, i.e., on the basis of coin count data Dc derived from the coin sensor CS of FIG. 1.

Further, if the result of the judgement at the step 113 is NO, it is judged that there has been a prank such as pulling back of the coin with a piece of thread fixed thereto over the coin judged as a true coin at the step 110 and that coin is treated as a false coin.

In this case, no true-coin detection signal is generated, and thus occurrence of true-coin error counting due to the prank is prevented.

The operation when a true coin is inserted, is illustrated under the heading (a) "COIN INSERTED" in the timing chart of FIG. 4, and the operation when counter-flow of the coin occurs is illustrated under heading (d) "COIN COUNTER-FLOW OCCURRED" in the timing chart of FIG. 4.

What is claimed is:

1. A coin processing apparatus comprising:

coin discriminating means disposed along a coin path and including a plurality of sets of coin selecting coil means each set comprising an exciting coil adapted to be excited with a signal of a predetermined frequency and a receiving coil provided in opposing relationship to said exciting coil with said coin path intervened therebetween, for discriminating a coin passing through said coin path on the basis of a level of output derived from the receiving coil of each of said coin selecting coil means in response to the coin passing through said coin path;

a coin return lever arranged, when operated, to cause said exciting coil and said receiving coil in each of said plurality of sets of coin selecting coil means to be spaced apart from each other, thereby guiding the coin lying in said coin path to a coin return path;

first detecting means for detecting that levels of outputs of the respective receiving coils in said plurality of sets of coin selecting coil means concurrently exceed a predetermined threshold level;

first timer means for counting a first time period;

second detecting means for respectively detecting that the level of output of each receiving coil in said plurality of sets of coins selecting coil means exceeds said predetermined threshold level;

second timer means for counting a second time period;

means for judging, on the basis of detection output derived from said second detecting means, that coin jamming has occurred if the level of output of the receiving coil in at least one of said plurality of sets of coin selecting coil means persists longer than the second time period counted by said second timer means; and cancel processing means arranged to cancel acceptance of the inserted coin if detection output derived from said first detection means persists longer than said first time period counted by said first timer means.

2. A coin processing apparatus according to claim 1 further comprising:

third detecting means for detecting that the output level of the receiving coil in the most downstream one of said plurality of sets of coin selecting coil means exceeds said predetermined threshold level;

third timer means for counting a third time period; and true-coin cancellation processing means for treating a coin judged as a true coin to be a false coin if said third detecting means generates a detection output again after a lapse of the third time period counted by said third timer means from a point of time when the output of said third detecting means has ceased.

* * * * *